United States Patent [19]

Mazuda et al.

[11] Patent Number: 4,591,396

[45] Date of Patent: May 27, 1986

[54] METHOD OF PRODUCING STEEL HAVING HIGH STRENGTH AND TOUGHNESS

[75] Inventors: Hiroo Mazuda; Hiroshi Tamehiro; Mamoru Ohashi, all of Kimizu; Yasumitsu Onoe, Kitakyushu; Shinogu Tamukai, Nakama, all of Japan

[73] Assignee: Nippon Steel Corporation, Tokyo, Japan

[21] Appl. No.: 646,490

[22] Filed: Sep. 4, 1984

Related U.S. Application Data

[63] Continuation of Ser. No. 519,897, Aug. 4, 1983, abandoned, which is a continuation of Ser. No. 313,707, Oct. 21, 1981, abandoned.

[30] Foreign Application Priority Data

Oct. 30, 1980 [JP] Japan ..... 55/151417

[51] Int. Cl.[4] ..... C21D 7/14

[52] U.S. Cl. ..... 148/12 F

[58] Field of Search ..... 148/12 F

[56] References Cited

U.S. PATENT DOCUMENTS

| | | | |
|---|---|---|---|
| 4,008,103 | 2/1977 | Miyoshi et al. | 148/12 F |
| 4,105,474 | 8/1978 | Nakasugi et al. | 148/12 F |
| 4,138,278 | 2/1979 | Nakasugi et al. | 148/12 R |
| 4,153,454 | 5/1979 | Emi et al. | 75/123 E |
| 4,184,898 | 1/1980 | Ouchi et al. | 148/12 F |
| 4,188,241 | 2/1980 | Watanabe et al. | 148/12 F |
| 4,219,371 | 8/1980 | Nakasugi et al. | 148/12 F |
| 4,316,753 | 2/1982 | Kaneko et al. | 148/12 F |

OTHER PUBLICATIONS

"Control of Microstructure by the Processing Parameters and Chemistry in the Arctic Line Pipe Steels", by Chiaki Ouchi, Junichi Tanaka, Isao Kosasu, and Koshiro Tsukada, issued in Micon 78: Performance Through Microstructural Control, ASTM STP 672, Halle Abrams, G. N. Maniar, D. A. Nail, and H. D. Solomon (Editors), pp. 105–125, Philadelphia, Pa. 1979, (Thesis of Nippon Kokan K.K., Japan).

*Primary Examiner*—Wayland Stallard

*Attorney, Agent, or Firm*—Pollock, Vande Sande & Priddy

[57] ABSTRACT

A micro-alloy plate having not only high tensile strength and high toughness both at room temperature and low temperature but which also displays superior weldability and excellent toughness at a heat affected zone (HAZ) of welding.

The steel contains 0.005–0.08 C, not more than 0.6% Si, 1.4–2.4% Mn, 0.01–0.03% Nb, 0.005–0.025% Ti, 0.005–0.08% Al, not more than 0.003% S, 0.0005–0.005% Ca, not more than 0.005% O, not more than 0.005% N, all being represented by weight and the balance being incidental impurities, further the steel must satisfy the following requirements;

$$-0.002\% \leqq N - \frac{Ti}{3.4} \leqq 0.002\% \quad \text{(A)}$$

$$-1.5 \geqq \frac{[Ca]\{1 - 124[O]\}}{1.25[S]} \geqq 0.4 \quad \text{(B)}$$

The steel thus prepared is heated at a temperature range of 900°–1000° C., hot rolled with a rolling reduction of more than 60% below 900° C. with a rolling finishing temperature within a range from 20° C. above the $Ar_3$ point down to 10° C. below the $Ar_3$ point and, immediately after the rolling, the steel stock is cooled down to 300° C. or lower at a cooling rate of 15°–60° C./sec.

The steel may further contain small amounts of at least one alloying element selected from the group of Ni, Cu, Cr, Mo, V and B.

Due to these composition controls together with controlled heating, rolling and cooling, the product steel stock obtains a very fine grained and uniform microstructure and thereby satisfies the required mechanical properties suitable for use in welded constructions in many fields such as buildings, pressure vessels, the ship building industry and pipe lines.

16 Claims, 1 Drawing Figure

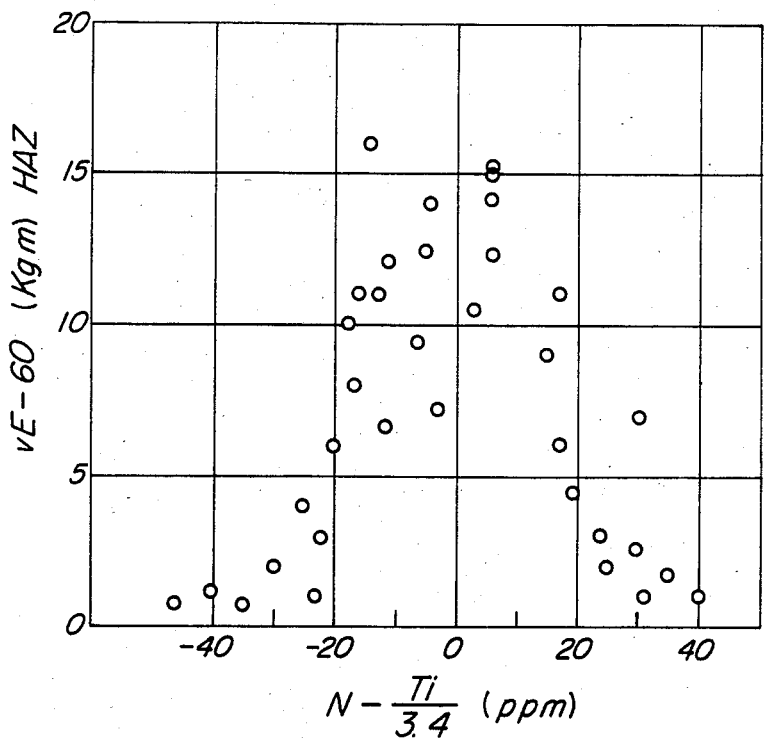
20
15
10
5
0
vE-60 (Kgm) HAZ
-40
-20
0
20
40
N - Ti/3.4 (ppm)

METHOD OF PRODUCING STEEL HAVING HIGH STRENGTH AND TOUGHNESS

This application is a continuation of application Ser. No. 519,897, filed 8/4/83, which, in turn, is a continuation of U.S. Ser. No. 313,707, filed 10/21/81, both now abandoned.

BACKGROUND OF THE INVENTION

The present invention relates to a method of producing a steel having high strength, high toughness and excellent weldability, by a combination of a specific condition of chemical composition of the steel and a specific condition for heating and rolling, as well as cooling after the rolling.

In recent years, the use of high tensile steel has become popular in the field of production of welded constructions in such as buildings, pressure vessles, ship building, line pipes and so forth, from the view point of economy and safety. This in turn gives rise to a demand for improved weldable high tensile steel. For attaining a higher safety and workability, the high tensile steel for welded constructions are required to have a high toughness, as well as superior weldability and weld zone characteristics. These requirements are becoming severer, year by year.

A controlled-rolling method (CR method) is widely used for the production of line pipe material, steel for low temperature use and so forth. Also, a so-called QT method in which quenching and tempering are effected subsequently to the rolling is known as a method which can cope with the above-stated demand. The CR method, however, has a practical limit in the increase of the strength, and encounters a deterioration in weldability and rise in costs when the amount of alloying addition is increased. The QT method is also disadvantageous in the cost of production of steel due to the necessity for the re-heating.

Under these circumstances, there is a vigorous movement for the development of a method called controlled-cooling method in which various measures are taken to save energy and natural resources, particularly alloying elements.

The steel produced in accordance with the controlled-cooling method have advantages of both of the CR method and the QT method. Namely, the steel produced by this method exhibits superior characteristics as a micro alloy steel or a steel having no special alloying element. Unfortunately, however, this steel had only a limited use and could not practically satisfy the strict demand for toughness in the base metal and weld zone as the materials for pipe lines and steels for low temperature use, because of the disadvantages or problems stated hereinbelow.

(1) The austenite grains become inconveniently coarser due to the excessively high heating temperature, resulting in a coarser microstructure after transformation through cooling and reduced low temperature toughness.

(2) Due to the low rolling reduction in the recrystallization zone and nonrecrystallized zone, the microstructure after transformation becomes coarse to reduce the low temperature toughness.

(3) Absorbed energy in the impact test is seriously lowered because of the two-phase region rolling which is conducted to improve the arresting characteristics for brittle fracture and to prevent softening due to welding.

In consequence, the chance of brittle fracture initiation is increased and the resistance to the unstable ductile fracture is deteriorated.

(4) Martensite is formed if the cooling rate is too high, resulting in lower absorbed energy in the impact test. A tempering becomes inevitable to improve toughness.

(5) The microstructure and, hence, the hardness is not uniform in the through-thickness direction of the steel plate.

(6) Micro cracks are likely to be induced by $H_2$ because of the water cooling effected immediately after the rolling.

(7) The toughness in the Heat-Affected Zone (HAZ) in weld is much inferior to that of the base metal, because no specific consideration is made as to the HAZ toughness.

Due to these problems or drawbacks, the steel produced by the controlled-cooling method has an extremely limited use.

Among the prior art methods of producing high tensile-strength low-alloy steel plates with good toughness, U.S. Pat. No. 4,184,898 developed by Ouchi et al is considered to be an invention which utilizes accelerated cooling subsequent to controlled heating and rolling.

Ouchi et al's. U.S. Pat. No. 4,184,898 is directed to obtain a steel having high strength and high toughness at low temperature but it does not positively aim at improving both weldability and the mechanical properties at the heat affected zone (HAZ) caused by welding.

On the other hand, the present invention is directed to the method of producing high tensile-strength low-alloy steel having superior weld zone properties.

So far as the chemical composition of the respective alloy is concerned there exists some extent of overlapping with respect to the allowable ranges of carbon, silicon, manganese, niobium and aluminum.

However, with respect to restriction to other chemical components the present invention differs from the U.S. Pat. No. 4,184,898 regarding critical limitation on the upper limits for sulphur, calcium, oxygen and nitrogen as well as specifically recited conditions concerning several ingredients represented by two formulas;

$$-0.002\% \leqq N - \frac{Ti}{3.4} \leqq 0.002\% \quad (1)$$

$$-1.5 \geqq \frac{[Ca]\{1 - 124[O]\}}{1.25[S]} \geqq 0.4. \quad (2)$$

As to thermal conditions and rolling, that is, heating, rolling reduction and cooling of the steel, the present invention differs greatly from the U.S. Pat. No. 4,184,898 particularly with respect to heating temperature, cooling speed and the temperature at which further cooling down to lower temperature has to be stopped.

Speaking of actual value of these thermal and rolling conditions, comparison will be made now between the present invention and the Ouchi, et al's. U.S. Pat. No. 4,184,898.

According to the present invention, the steel which satisfies the specified chemical restriction is heated at 900°-1000° C. and rolled to effect more than 60% of rolling reduction below 900° C. and the rolling to be finished within a temperature range of between plus 20° C. of $Ar_3$ transformation temperature and minus 10° C., then the rolled steel is cooled to 300° C. or lower down to room temperature at a cooling rate of 15°-60° C./sec.

On the other hand, said patent to Ouchi, et al. comprises the steps of heating the steel at a temperature above plus 150° C. of $Ar_3$ transformation temperature but below the temperature at which austenite grain size would become 150μ (micron) or higher, hot rolling the steel to obtain total reduction of more than 40% and cooling the hot rolled steel to a temperature within 550°-650° C. at a cooling speed of 5°-20° C./sec.

Briefly speaking, the present invention heats the steel at a lower temperature for rolling and cools the rolled steel to considerably lower temperature range with fairly faster cooling rate.

Differences in these thermal conditions are necessitated in order to obtain superior weldability and good weld zone properties to be obtained by this invention. That is, so as to accomplish such good welding properties carbon content must be kept within a range of 0.005-0.08%, which makes it difficult to obtain both high tensile strength and high toughness by relying on such an extent of controlled rolling followed by accelerated cooling as suggested by said Ouchi, et al. patent.

The present invention has been accomplished by the refinement of austenite grain size brought about by the critical restriction to chemical compositions and rolling conditions combined with lower temperature heating for rolling and cooling down to lower temperature range at a faster cooling rate.

SUMMARY OF THE INVENTION

In order to obviate these problems or drawbacks of the prior art, the present inventors have made an intense study concerning various factors such as alloy component system, conditions of heating, rolling and cooling and so forth, and have found out a novel method which makes it possible to produce a steel having a superior weldability and HAZ toughness, not to mention the strength and toughness.

Namely, a major object of the invention is to provide a method of producing a low alloy steel plate which exhibits a high tensile strength and toughness not only at the normal temperature but also at low temperature, as well as a good weldability and high toughness in the heat affected zone.

More specifically, the present invention aims at providing a method which permits, by a suitable limitation of chemical components such as alloying elements, inevitable or unavoidable elements and impurities, and a careful selection of conditions for heating, rolling and cooling, the production of a low alloyed high tensile strength steel having a sufficient strength and toughness even at low temperature and high weldability, while exhibiting a sufficiently high toughness even in the heat affected zone, in view of the current demand for the high tensile strength steel which is now finding a spreading use as the material of welded constructions from both of safe and economical points of view.

BRIEF DESCRIPTION OF THE DRAWINGS

The attached sole FIGURE is a graph showing the result of a Charpy impact test conducted with steels produced in accordance with the method of the invention.

DESCRIPTION OF THE PREFERRED EMBODIMENTS

The characteristic feature of the invention resides in effecting a morphological controlling treatment of MnS by an addition of Ca while extremely reducing the sulfur content of a steel, adding Ti and small amount of Nb to form a steel of low C content and high Mn content, heating the steel slab to a low temperature of 900° to 1000° C., effecting a rolling in the recrystallization area of austenite grains, effecting a sufficient reduction exceeding 60% in the nonrecrystallized region of below 900° C., and, immediately after finishing the rolling at a temperature ranging between a temperature 20° C. above the $Ar_3$ transformation temperature and a temperature 10° C. below the $Ar_3$ effecting a cooling at a comparatively high rate of 15° to 60° per second.

According to this method, the microstructure obtained after the cooling is fine upper bainite or a duplex structure of fine bainite and ferrite, and, hence, exhibits a superior strength and toughness.

The refining of the microstructure is obtained as a synergistic effect of grain refining processes as stated below.

(1) Refinement of heated austenite grain attributable to the low heating temperature (900° to 1000° C.) and depression of the grain growth by fine TiN particles.

(2) Depression of the growth of austenite grains recrystallized during rolling, due to the presence of TiN and Nb(C,N).

(3) Because of the depression of recrystallization of austenite grains by the fine Nb(C,N) particles precipitated during the rolling operation and the sufficient cumulative rolling reduction of 60% or higher at low temperature below 900° C., the austenite grains are sufficiently elongated to increase the transformation nuclei of ferrite grains.

Thanks to the combined effect of the abovementioned refinement of microstructure, extreme reduction of sulfur content and the shape-controlling treatment of MnS by the addition of Ca, it is possible to produce a high tensile strength steel plate having superior impact transition temperature and absorbed energy.

The large rolling reduction in excess of 60% effected at the non-recrystallized region below 900° C. provides the microstructure having a gradient of grain size decreasing toward the plate surfaces, that is finer at the plate surfaces, so that the surface is less hardenable. In consequence, the microstructure is substantially uniform in the through-thickness direction of the plate to ensure a uniform hardness distribution in the through-thickness direction.

The steel plate material thus produced is quite stable in its quality.

As has been described, the present invention provides a method which makes it possible to produce a high strength and high toughness steel at a low cost.

Owing to the reduced carbon equivalent, the steel produced by this method of the invention exhibits a lower sensitivity to welding cracking as compared with conventional steel materials. In addition, the toughness in the heat affected zone is remarkably improved thanks to the precipitation of a suitable amount of fine TiN due to the addition of Ti in an amount equivalent to N to the low carbon composition.

Therefore, the steel material produced by the method of the invention can be applied to various uses such as architectural structures, pressure vessles, ship building, pipe lines and so forth.

An explanation will be made hereinunder as to the reasons of limitations to conditions of heating, rolling and cooling.

The reason why the heating temperature is limited to fall between 900° and 1000° C. is that, by so doing, it is possible to maintain the austenite grain size sufficiently small during the heating so as to achieve a sufficient grain refinement of the rolled microstructure. The temperature 1000° C. is the upper limit necessary for avoiding the undesirable coarsening of the austenite grains during the heating. Namely, a heating temperature in excess of 1000° C. permits the coarsening of the austenite grains and, accordingly, a coarsening of the upper bainite structure after the cooling, resulting in an inferior toughness of the product steel. On the other hand, a too low heating temperature cannot sufficiently solutionize the adding alloying elements and induces segregation, thereby degrading the property of the steel. In addition, since the temperature at the final stage of rolling becomes too low, it is not possible to make full use of the improvement offered by the controlled cooling. For these reasons, the lower limit of the temperature is selected to be 900° C.

In the method of the invention, since there is a rule that the heating is made at a low temperature, no substantial waiting time is required even though the rolling reduction at a temperature below 900° C. is selected to be 60% or higher and, accordingly, the productability is remarkably high. However, if the rolling is conducted under inadequate condition, it is not possible to obtain the product having the desired high quality, even if the heating is conducted at such a low temperature. Namely, according to the invention, it is essential that the rolling reduction in the non-recrystallized temperature region of less than 900° C. must be kept 60% or higher. Such a high rolling reduction at the non-crystallized temperature region, following the heating at the low temperature, ensures the refinement and elongation of the austenite grains so as to obtain fine and uniform transformation structure formed after cooling.

Thus, according to the invention, it is necessary to sufficiently elongate the fine austenite grains by rolling in order that sufficiently refined upper bainite structure can be formed after the rolling and subsequent cooling otherwise, the toughness of the products would be seriously lowered.

The cooling after the rolling has to be achieved in such a way that a fine upper bainite structure can be formed uniformly throughout the plate thickness, in order to obtain satisfactory strength and toughness. For realizing a uniform and fine upper bainite structure, the temperature at which the cooling is started ranges between the $Ar_3$ transformation temperature and a temperature 20° C. above the $Ar_3$. However, no substantial lowering of strength is observed even if the temperature is partially lowered to fall between the $Ar_3$ transformation temperature and the temperature 10° C. below the $Ar_3$ to form a duplex phase microstructure containing upper bainite and less than 20% of ferrite. Such a duplex phase microstructure does not cause any appreciable reduction of the toughness because the microstructure is sufficiently fine.

Thanks to the refinement of the upper bainite structure, reduced C content, extremely reduced S content and the morphological controlling treatment of MnS, it is possible to achieve a remarkable improvement in the ductility and toughness.

According to the invention, it is necessary that the cooling is started immediately after the completion of rolling till the steel temperature is lowered down to 300° C. at a cooling rate of between 15° and 60° C./sec. The reason for this fast cooling rate is that the upper bainite structure can hardly be formed at a cooling rate below 15° C./sec while a cooling rate in excess of 60° C. per second permits the formation of such a large amount of martensite as to reduce the ductility and toughness. The reason why the steel is cooled down to 300° C. is to improve the productivity and working efficiency and to stabilize the quality of the steel product through simplification of the cooling condition.

In the case where the steel plate has a large thickness of, for example, 40 mm or greater, a reheating may be required for the purpose of dehydrogenation or the like. The reheating temperature should not exceed 600° C., otherwise, the strength is lowered undesirably. The invention, however, does not exclude a reheating up to a temperature of 550° C. or lower, which does not impair the property of the steel of the present invention.

An explanation will be made hereinunder as to the reason for limiting the amounts of constituents.

The steel material for use in the method in accordance with the first embodiment of the invention has a composition containing 0.005 to 0.08% of C, not more than 0.6% of Si, 1.4 to 2.4% of Mn, 0.01 to 0.03% of Nb, 0.005 to 0.025% of Ti, 0.005 to 0.08% of Al, and 0.0005 to 0.005% of Ca. The steel material has to meet also a requirement of not more than 0.005% of O, not more than 0.005% of N, not more than 0.0002% of H and conditions stipulated by the formulas $$-0.002\% \leqq N - \frac{Ti}{3.4} \leqq 0.002\% \text{ and } 1.5 \leqq \frac{[Ca]\{1 - 124[O]\}}{1.25[S]} \geqq 0.4.$$

The lower limit value of C content of 0.005% is selected to ensure sufficient strength in the base metal and in the weld joint, and to provide a sufficient effect of precipitation of carbides of Nb and/or V. A too large C content, on the other hand, causes a formation of martensite islands in the course of the controlled cooling, to deteriorate not only the ductility and toughness but also the weldability, as well as the toughness in the heat affected zone.

Si is inevitably involved due to deoxidation. This element has to be limited also to be not more than 0.6% because it adversely affects the weldability and the toughness in the heat affected zone. The Si content is preferably maintained to be less than 0.2% because the deoxidation of the steel can be performed by Al solely.

Mn is an important element in the present invention, because it enhances the effect of improvement of the strength and toughness produced by the series of operation consisting of the low temperature heating and rolling and controlled cooling. Mn content below 1.4% cannot provide sufficient strength nor substantial effect in improving the toughness. For this reason, the lower limit of the Mn content is selected to be 1.4%. To the contrary, excessive amount of Mn increases hardenability and gives rise to allow liable formation of martensite thereby deteriorates the toughness both in the base metal and the heat affected zone. For this reason, the upper limit of the Mn content is selected to be 2.4%.

Nb dissolves into solid solution by heating thereafter precipitates in the form of carbo-nitrides in the course of the subsequent rolling, to depress the growth of austenite grains thereby to refine the microstructure of the steel. To this end, 0.01% of Nb content is sufficient.

The precipitation hardening effect brought about by Nb is increased as the Nb content is increased to enhance the strength of the steel. However, the steel is excessively hardened when the Nb content is increased beyond 0.03% and degrades the weldability and toughness in the heat affected zone seriously.

In the method of the invention, the addition of Nb is intended mainly for achieving a higher toughness through grain refinement, while the improvement in the strength is achieved through change of structure by the controlled cooling. Therefore, the Nb content is limited to a level which is low but enough to effect a substantial improvement in the toughness and not to deteriorate the weldability and toughness in the heat affected zone. For these reasons, the Nb content is limited to fall between the lower limit of 0.01% and the upper limit of 0.03%.

Since the C content and the N content in solid solution are maintained sufficiently low, a suitable amount of Nb is solutionized even in the low temperature heating at 900° to 1000° C. which is adopted to improve the toughness of the base metal and the productivity. It is, therefore, possible to make full use of non-recrystallization and refinement effects of austenite grains.

Ti forms, when its content is sufficiently small such as between 0.005 and 0.025%, fine TiN particles to effectively contribute to the refinement of the rolled microstructure and the heat affected zone, i.e. to the improvement in the toughness. The content of N and Ti preferably take values approximating stiochiometrically equivalent amounts. More specifically, the N and Ti contents are preferably selected to meet the condition specified by $-0.002\% \leqq N-(Ti/3.4) \leqq 0.002\%$. A Charpy impact test was conducted to investigate the relationship between the toughness in the heat affected zone and the value of $N-(Ti/3.4)$, the result of which is shown in the FIGURE. The C contents of the steels used in this test range from 0.01 to 0.08% and the thickness falling between 13 and 30 mm.

In the region where the $N-(Ti/3.4)$ exceeds 0.002%, the amount of free N is so large that high carbon matensite islands are liable to be formed in the heat affected zone to drastically deteriorate the toughness in that zone. In the region where the $N-(Ti/3.4)$ is below $-0.002\%$, coarse TiN particles tend to be formed to unfavourably decrease the refinement effect of the TiN. For these reasons, the N and Ti contents are selected to meet the condition of $-0.002\% \leqq N-(Ti/3.4) \leqq 0.002\%$.

Al is an element unavoidably involved in the killed steel of this kind due to the process of deoxidation. The deoxidation cannot be achieved to a satisfactory extent so that the toughness of the base metal is unfavourably decreased, when the Al content is below 0.005%. For this reason, the lower limit of Al content is selected to be 0.005%. To the contrary, the upper limit of the Al content is selected to be 0.08%, because an Al content exceeding 0.08% causes a deterioration of cleanliness and toughness in the heat affected zone.

According to the invention, the S content as an impurity is limited to be not more than 0.003%, and is restricted in relation to Ca to meet the condition of $$1.5 > \frac{[Ca]\{1 - 124[O]\}}{1.25[S]} \geqq 0.4,$$

mainly for the purpose of improving the ductility and toughness of the base material, as well as the cleanliness.

As stated before, the method of the invention includes the steps of heating and rolling at a low temperature and a subsequent step of controlled cooling. Generally, ductility and toughness are lowered as the strength is increased. The low temperature heating and the controlled cooling make the dehydrogenation insufficient and often allow micro cracks to occur induced by hydrogen due to MnS. This problem, however, can be overcome by reducing the S content, i.e. the absolute amount of MnS in the steel and by effecting a morphological control of MnS by an addition of Ca.

It is possible to remarkably reduce the elongated MnS by selecting the Ca, O and S contents to satisfy the condition of $$\frac{[Ca]\{1 - 124[O]\}}{1.25[S]} \geqq 0.4$$

while reducing the S content down to a level below 0.003%. Similarly, by maintaining the $$\frac{[Ca]\{1 - 124[O]\}}{1.25[S]}$$

at a level of 1.5 or less, it is possible to minimize the formation of the clustering inclusions, such as $CaO.Al_2O_3$, thereby to appreciably improve the ductility and toughness, as well as the cleanliness.

For these reasons, the upper limit of S content is selected to be 0.003%, while the upper and lower limits of $$\frac{[Ca]\{1 - 124[O]\}}{1.25[S]}$$

are selected to be 1.5 and 0.4, respectively. The advantageous effect of the S content becomes greater as it is decreased. A remarkable improvement is achieved by decreasing the S content down to the level below 0.001%.

Oxygen is unavoidably involved in the molten steel to deteriorate the cleanliness and toughness of the steel. A too large O content requires large amounts of deoxidizing alloys such as Al and Si or ferro-alloys, and reduces the effective amount of Ca necessary for the morphological control of MnS due to combination of O with Ca, while allowing the formation of oxide type coarse inclusions. For these reasons, the upper limit of the O content is selected to be 0.005%.

N also is involved in the molten steel to degrade the toughness. Particularly, free N tends to promote the formation of matensite islands in the heat affected zone to undesirably deteriorate the toughness in that region. In order to improve the toughness in the heat affected zone and the toughness of the rolled material, Ti is added as stated before. The advantageous effect brought about by TiN, however, is decreased as the N content is increased beyond 0.005%. The upper limit of N content, therefore, is selected to be 0.005%.

The method of the invention involves a fear of insufficient dehydrogenation to cause defects (micro cracks) induced by hydrogen, due to the adoption of the low temperature heating and controlled cooling. These defects, however, can be eliminated almost perfectly by limiting the H content to be less than 0.0002% at the greatest. From this point of view, the H content is preferably determined to be 0.0002% or lower.

According to a second embodiment of the invention, the steel material used contains, in addition to the constituents and process mentioned in the description of the first embodiment, one two or more elements selected from a group consisting of 0.1 to 1.0% of Ni, 0.1 to 0.6% of Cu, 0.1 to 0.6% of Cr, 0.05 to 0.3% of Mo, 0.01 to 0.08% of V, and 0.0005 to 0.002% of B.

The major purpose of the addition of these elements is to expand the upper limit of the thickness of steel plates to be processed, while attaining a higher strength and toughness, without substantially impairing the advantages of the invention. The amount of addition of these elements are naturally limited from the view points of weldability and toughness in the heat affected zone.

Ni has a characteristic to enhance the strength and toughness of the base metal without adversely affecting the hardenability and toughness in the heat affected zone. The Ni content below 0.1%, however, cannot provide any appreciable effect, while an Ni content in excess of 1.0% is unfavourable from the view points of hardenability and toughness in the heat affected zone. Therefore, the lower limit and upper limit of the Ni content are selected to be 0.1% and 1.0%, respectively.

Cu is substantially equivalent in effect to the Ni, and has an appreciable anti-corrosion effect, as well as resistance to internal blistering induced by hydrogen sulfide. However, no substantial effect is observed by Cu content less that 0.1%. To the contrary, a Cu content in excess of 0.6% tends to cause a Cu cracking during the rolling operation even when the rolling is effected at such a low temperature as in the method of the invention. For these reasons, the upper and lower limits of Cu content are selected to be 0.6% and 0.1%, respectively.

Cr is effective in enhancing the strength of the base metal, as well as in the prevention of internal blistering induced by hydrogen sulfide. Cr content less than 0.1%, however, does not provide any appreciable effect, while a Cr content in excess of 0.6% causes an increase of the hardenability to decrease the toughness and the weldability undesirably. The Cr content, therefore, is selected to fall between 0.1% and 0.6%.

Mo is an element which is effective in improving both strength and toughness. However, no substantial effect is derived from Mo if the Mo content is below 0.05%. To the contrary, a too large Mo content excessively increases the hardenability as in the case of Cr, to unfavourably degrade the toughnesses in the base metal and in the weld zone, and also the weldability. The Mo content, therefore, is selected to fall between the lower limit of 0.05% and the upper limit of 0.3%.

V is substantially equivalent in effect to Nb but cannot provide any remarkable effect when its content is below 0.01%. The V content can be increased up to 0.08% without being accompanied by any substantial harmful effect. The upper limit of 0.08% and the lower limit of 0.01% of the V content are selected for these reasons.

B segregates at austenite grain boundaries during the rolling operation to improve the hardenability and to promote the formation of the bainitic microstructure. Boron content less than 0.0005% cannot provide any appreciable improvement in the hardenability, while B in excess of 0.002% permits the formation of BN (boron nitride) and B constituents to undesirably degrade the toughness in the base metal and in the heat affected zone. From this fact, the B content is selected to fall between the lower limit of 0.0005% and the upper limit of 0.002%.

Practical examples of the embodiments of the invention will be described hereinunder to make the advantages of the invention fully understood.

Steels having chemical compositions as shown in Table 1 are prepared by an oxygen converter-continuous casting process. Steel plates of thicknesses between 15 and 30 mm were produced from these steels by processes under various conditions for heating, rolling and cooling.

TABLE 1

| Items | Steels | Chemical composition (%) C | Si | Mn | Nb | Ti | Al | ppm S | Ca | N | O | H | $N-\frac{Ti}{3.4}$ (ppm) | $\frac{[Ca]\{1-124[O]\}}{1.25[S]}$ [0]: (%) |
|---|---|---|---|---|---|---|---|---|---|---|---|---|---|---|
| Steels of the Invention | 1 | 0.04 | 0.27 | 1.90 | 0.02 | 0.015 | 0.023 | 0.002 | 50 | 50 | 40 | 1.5 | 6 | 1.0 |
| | 2 | 0.04 | 0.30 | 2.10 | 0.03 | 0.016 | 0.037 | 0.001 | 42 | 42 | 45 | 1.7 | 25 | 1.5 |
| | 3 | 0.05 | 0.30 | 1.95 | 0.02 | 0.015 | 0.032 | 0.001 | 24 | 30 | 32 | 1.8 | −14 | 1.2 |
| | 4 | 0.03 | 0.28 | 1.40 | 0.01 | 0.017 | 0.035 | 0.002 | 38 | 46 | 37 | 2.0 | −4 | 0.8 |
| | 5 | 0.04 | 0.29 | 2.40 | 0.01 | 0.018 | 0.028 | 0.001 | 24 | 42 | 33 | 1.9 | −11 | 1.1 |
| | 6 | 0.07 | 0.31 | 1.62 | 0.02 | 0.015 | 0.033 | 0.001 | 20 | 47 | 42 | 1.9 | 3 | 0.8 |
| | 7 | 0.04 | 0.26 | 1.60 | 0.03 | 0.017 | 0.024 | 0.003 | 28 | 40 | 38 | 1.3 | −10 | 0.4 |
| Steels for comparison | 8 | 0.04 | 0.27 | 1.90 | 0.02 | 0.015 | 0.023 | 0.002 | 50 | 50 | 40 | 1.5 | 6 | 1.0 |
| | 9 | 0.04 | 0.27 | 1.90 | 0.02 | 0.015 | 0.023 | 0.002 | 50 | 50 | 40 | 1.5 | 6 | 1.0 |
| | 10 | 0.04 | 0.27 | 1.90 | 0.02 | 0.015 | 0.023 | 0.002 | 50 | 50 | 40 | 1.5 | 6 | 1.0 |
| | 11 | 0.12 | 0.29 | 1.60 | 0.04 | 0.018 | 0.034 | 0.002 | — | 38 | 25 | 2.4 | −15 | 0 |
| | 12 | 0.08 | 0.29 | 1.40 | 0.05 | 0.024 | 0.038 | 0.006 | — | 32 | 30 | 1.9 | −39 | 0 |

| Items | Steels | Other elements (%) | Processing conditions: Heating temperature (°C.) | Rolling reduction at temp. below 700° C. (%) | Rolling finish temp. (°C.) | $Ar_3$ transformation (°C.) | Cooling rate (°C./S) | Cooling finish temp. (°C.) | Plate thickness (nm) | Remarks |
|---|---|---|---|---|---|---|---|---|---|---|
| Steels of the Invention | 1 | | 1000 | 90 | 750 | 740 | 20 | room temp. | 22 | |
| | 2 | Mo 0.25 | 1000 | 90 | 740 | 730 | 20 | room temp. | 24 | |
| | 3 | Ni 0.5 Cu 0.5 | 950 | 85 | 710 | 705 | 15 | room temp. | 30 | Tempered at 500° C. for 10 min. |
| | 4 | Or 0.3 | 1000 | 85 | 750 | 765 | 40 | room temp. | 15 | |
| | 5 | V 0.5 | 1000 | 80 | 705 | 695 | 20 | room temp. | 19 | |
| | 6 | | 1000 | 80 | 740 | 745 | 20 | room temp. | 20 | |
| | 7 | | 900 | 60 | 740 | 750 | 25 | room temp. | 19 | |
| Steels for comparison | 8 | | 1150 | 90 | 745 | 740 | 20 | room temp. | 22 | |
| | 9 | | 1000 | 50 | 730 | 740 | 20 | room temp. | 22 | |
| | 10 | | 1000 | 90 | 670 | 740 | 20 | room temp. | 22 | |
| | 11 | | 1000 | 90 | 715 | 725 | 20 | room temp. | 22 | |

TABLE 1-continued

| | | | | | | | | |
|---|---|---|---|---|---|---|---|---|
| 12 | 1000 | 90 | 740 | 755 | 20 | room temp. | 22 | |

Table 2 shows the mechanical properties of the base metals and welded joints.

TABLE 2

| | | Properties of base metal (Note 2) | | | | Property of weld zone (Note 3) |
|---|---|---|---|---|---|---|
| Items | Steels | YS (Kg/mm²) | TS (Kg/mm²) | 2vE-60 (kg · m) | vTrs (°C.) | (HAZ) vE-60 (Kg · m) |
| Steels | 1 | 44.5 | 66.0 | 31.4 | <−120 | 15.0 |
| of | 2 | 55.0 | 74.2 | 34.2 | <−120 | 12.4 |
| the | 3 | 46.0 | 68.1 | 35.4 | <−120 | 16.0 |
| in- | 4 | 43.2 | 65.0 | 29.0 | <−120 | 14.0 |
| ven- | 5 | 56.1 | 71.2 | 31.0 | <−120 | 12.1 |
| tion | 6 | 42.1 | 65.4 | 26.2 | <−120 | 10.5 |
| | 7 | 41.6 | 60.5 | 27.3 | <−120 | 14.3 |
| Steel | 8 | 46.0 | 67.2 | 18.1 | −80 | 14.2 |
| for | 9 | 42.0 | 64.7 | 9.2 | −60 | 12.3 |
| com- | 10 | 48.0 | 67.0 | 9.1 | <−120 | 15.2 |
| pari- | 11 | 43.5 | 64.1 | 10.4 | −80 | 2.8 |
| son | 12 | 46.3 | 62.2 | 8.1 | −90 | 2.1 |

(Note 2) Values as measured in the direction perpendicular to rolling direction
(Note 3) Charpy impact value in the mid-thickness heat affected zone at a point 1 mm from the fusion line in submerged arc welding at heat input of 40 to 70 KJ/cm.

The steel plate produced from the steel of the invention exhibited extremely superior characteristics at the base metals and weld zones, whereas, in the steels for comparison which are not produced in accordance with the method of the invention, either at the base metal or at the weld zone exhibited unacceptable properties. Clearly, the steel materials produced in accordance with the method of the invention has a higher quality and adaptability as the materials for welded constructions.

The steel No. 8 for comparison had a non-uniform duplex grain structure due to a high heating temperature of 1150° C., to exhibit an inferior toughness at the base metal.

Also, the steel No. 9 for comparison showed an inferior toughness of the base metal due to excessively small rolling reduction at temperature below 900° C.

The steel No. 10 shows a large amount of separation due to an excessively low finishing temperature, resulting in a low absorption of impact energy.

In the steel No. 11, the toughness in the heat affected zone is low due to its high C content. In addition, the toughness of the base metal is degraded due to the lack of morphological control of MnS by the addition of Ca.

Finally, the steel No. 12 exhibits an excessively high hardening characteristics due to an excessive addition of Nb, as well as deteriorated toughness in the heat affected zone due to an excessive addition of Ti. The toughness in the base metal is also inferior because the MnS morphological control by addition of Ca has not been effected.

What is claimed is:

1. A method of producing a steel having high strength and toughness, as well as superior characteristics in a weld zone, comprising the steps of: preparing a steel material having a composition consisting of by weight 0.03 to 0.08% of C, not more than 0.6% of Si, 1.4 to 2.4% of Mn, 0.01 to 0.03% of Nb, 0.005 to 0.025% of Ti, 0.005 to 0.08% of Al, not more than 0.003% of S, 0.0005 to 0.005% of Ca, not more than 0.005% of O, not more than 0.005% of N, and the balance Fe and incidental impurities, said steel material further satisfying the conditions represented by formulas $-0.002\% \leqq N-(Ti/3.4) \leqq 0.002\%$ and the amount of each of Ca, O, and S being such as to satisfy the conditions of $$1.5 \geqq \frac{[Ca]\{1 - 124[O]\}}{1.25[S]} \geqq 0.4$$

to control the morphology of MnS and to minimize the formation of inclusions; heating said steel material to a temperature between 900° C. and 1000° C.: effecting a rolling on said steel material such that the rolling reduction at temperature below 900° C. is 60% or higher and that the rolling is finished at a temperature between a temperature 20° C. above the $Ar_3$ transformation temperature and a temperature 10° C. below the $Ar_3$ transformation temperature; and immediately after the completion of said rolling, cooling the rolled steel material down to a temperature below 300° C. at a cooling rate ranging between 15° C./sec. and 60° C./sec. to obtain fine upper bainite structure or a duplex structure of fine bainite and fine ferrite, whereby said steel has a toughness value of at least 10.5 kg.m in VE-60° C. with respect to the property of the welded zone.

2. A method of producing a steel having high strength and toughness, as well as superior characteristics in a weld zone, comprising the steps of preparing a steel material having a composition consisting of by weight 0.03 to 0.08% of C, not more than 0.6% of Si, 1.4 to 2.4% of Mn, 0.01 to 0.03% of Nb, 0.005 to 0.025% of Ti, 0.005 to 0.08% of Al, not more than 0.003% of S, 0.0005 to 0.005% of Ca, not more than 0.005% of O and not more than 0.005% of N, said steel material satisfying the conditions specified by formulas $\leqq 0.002\% - (Ti/3.4) \leqq 0.002\%$ and the amount of each of Ca, O, and S being such as to satisfy the conditions of $$1.5 \geqq \frac{[Ca]\{1 - 124[O]\}}{1.25[S]} \geqq 0.4$$

to control the morphology of MnS and to minimize the formation of inclusions, said steel further containing at least one element selected from a group consisting of 0.1 to 1.0% of Ni, 0.1 to 0.6% of Cu, 0.1 to 0.6% of Cr, the balance being Fe and incidental impurities; heating said steel material to a temperature between 900° C. and 1000° C.; effecting a rolling on said steel material such that the rolling reduction at temperature below 900° C. is 60% or higher and that the rolling is finished at a temperature between a temperature 20° C. above the $Ar_3$ transformation point and a temperature 10° C. below the $Ar_3$ transformation temperature; and immediately after the completion of said rolling, cooling the rolled steel material down to a temperature below 300° C. at a cooling rate ranging between 15° C./sec. and 60° C./sec. to obtain fine upper bainite structure or a duplex structure of fine bainite and fine ferrite, whereby said steel has a toughness value of not less than 10.5 kg.m in VE-60° C. with respect to the property of the welded zone thereof.

3. The method of claim 1 wherein the rolled steel material is cooled down to room temperature at a cooling rate ranging between 15° C./sec and 60° C./sec.

4. The method of claim 2 wherein the rolled steel material is cooled down to room temperature at a cooling rate ranging between 15° C./sec and 60° C./sec.

5. The method of claim 1 wherein the rolling is finished at a temperature between 705° C. and 750° C.

6. The method of claim 2 wherein the rolling is finished at a temperature between 705° C. and 750° C.

7. The method of claim 1 wherein the cooling rate is 25° C./sec.

8. The method of claim 2 wherein the cooling rate is 25° C./sec.

9. The method of claim 1 wherein the cooling rate is 40° C./sec.

10. The method of claim 2 wherein the cooling rate is 40° C./second.

11. The method of claim 1 wherein the composition contains less than 0.2% of Si.

12. The method of claim 2 wherein the composition contains less than 0.2% of Si.

13. The method of claim 1 wherein the composition contains less than 0.001% of S.

14. The method of claim 1 wherein the composition contains less than 0.001% of S.

15. The composition of claim 1 wherein the composition contains less than 0.0002% of H.

16. The composition of claim 2 wherein the composition contains less than 0.0002% of H.

* * * * *